US011351559B2

(12) United States Patent
Tani et al.

(10) Patent No.: US 11,351,559 B2
(45) Date of Patent: Jun. 7, 2022

(54) ROTARY ATOMIZATION HEAD AND COATING DEVICE

(71) Applicants: TOYOTA JIDOSHA KABUSHIKI KAISHA, Toyota (JP); TRINITY INDUSTRIAL CORPORATION, Toyota (JP)

(72) Inventors: Shinji Tani, Miyoshi (JP); Akira Numasato, Nagoya (JP); Takahito Kondo, Nisshin (JP); Yuki Murai, Nagoya (JP); Takao Ueno, Toyota (JP); Takatoshi Okuta, Toyota (JP); Ken Maeda, Toyota (JP); Kota Harada, Toyoake (JP)

(73) Assignees: TOYOTA JIDOSHA KABUSHIKI KAISHA, Toyota (JP); TRINITY INDUSTRIAL CORPORATION, Toyota (JP)

( * ) Notice: Subject to any disclaimer, the term of this patent is extended or adjusted under 35 U.S.C. 154(b) by 130 days.

(21) Appl. No.: 16/441,196

(22) Filed: Jun. 14, 2019

(65) Prior Publication Data

US 2019/0388915 A1 Dec. 26, 2019

(30) Foreign Application Priority Data

Jun. 21, 2018 (JP) ..... JP2018-118188

(51) Int. Cl.

| | |
|---|---|
| ***B05B 5/04*** | (2006.01) |
| ***B05B 5/053*** | (2006.01) |
| ***B05B 3/10*** | (2006.01) |

(52) U.S. Cl.

CPC ..... *B05B 5/0407* (2013.01); *B05B 3/1021* (2013.01); *B05B 5/0411* (2013.01); *B05B 5/0426* (2013.01); *B05B 5/053* (2013.01)

(58) Field of Classification Search

CPC ... B05B 3/1014; B05B 3/1021; B05B 5/0407; B05B 5/0411; B05B 5/0426; B05B 5/053; B05D 1/04

See application file for complete search history.

(56) References Cited

U.S. PATENT DOCUMENTS 2,220,275 A * 11/1940 Preston ..... F24F 6/16 239/223
2,850,322 A * 9/1958 Ingram ..... B05B 3/1057 239/222

(Continued)

FOREIGN PATENT DOCUMENTS

CN 106475244 A 3/2017
CN 108025321 A 5/2018

(Continued)

*Primary Examiner* — Darren W Gorman
(74) *Attorney, Agent, or Firm* — Sughrue Mion, PLLC

(57) ABSTRACT

A rotary atomization head is provided, which prevents discharged threads of a coating material from making contact with each other and from being unified. A rotary head 1 includes: a diffusion surface 122 to diffuse the coating material toward an outer edge part 123 by centrifugal force; and a plurality of grooves 124 formed on the outer edge part 123. The plurality of grooves 124 extends in a radial direction. The adjacent grooves 124 have different depths. The grooves 124 have the same width.

7 Claims, 9 Drawing Sheets

(56) References Cited

U.S. PATENT DOCUMENTS

| | | | | | |
|---|---|---|---|---|---|
| 4,148,932 | A * | 4/1979 | Tada | B05B 5/0407 | 239/3 |
| 4,458,844 | A * | 7/1984 | Mitsui | B05B 5/0407 | 239/222.11 |
| 4,495,086 | A * | 1/1985 | Hiroshima | B01F 3/0807 | 366/165.4 |
| 4,518,119 | A * | 5/1985 | Vetter | B05B 5/0407 | 239/223 |
| 4,519,549 | A * | 5/1985 | Yokoe | B05B 5/0407 | 118/626 |
| 4,784,332 | A * | 11/1988 | Takeuchi | B05B 5/0407 | 239/222.11 |
| 5,279,708 | A * | 1/1994 | Wood | B01D 1/18 | 159/48.1 |
| 8,840,043 | B2 * | 9/2014 | Nakazono | B05B 3/1092 | 239/243 |
| 2009/0140083 | A1 * | 6/2009 | Seitz | B05B 5/0533 | 239/690.1 |
| 2010/0155504 | A1 * | 6/2010 | Yamasaki | B05B 3/1014 | 239/214 |
| 2016/0339459 | A1 * | 11/2016 | Kishimoto | B05B 3/1014 | |
| 2017/0056901 | A1 | 3/2017 | Tani et al. | | |
| 2019/0083997 | A1 | 3/2019 | Kishimoto et al. | | |

FOREIGN PATENT DOCUMENTS

| | | | | | |
|---|---|---|---|---|---|
| GB | 846181 | A | | 8/1960 | |
| GB | 2008439 | A | * | 6/1979 | B05B 3/1021 |
| JP | 57027160 | A | * | 2/1982 | B05B 5/0407 |
| JP | 63-171659 | A | | 7/1988 | |
| JP | 2017-042749 | A | | 3/2017 | |
| JP | 2018-126716 | A | | 8/2018 | |
| WO | 2016-190027 | A1 | | 12/2016 | |

* cited by examiner

ROTARY ATOMIZATION HEAD AND COATING DEVICE

CROSS-REFERENCE TO RELATED APPLICATIONS

The present application claims priority under 35 U.S.C. § 119(a) to Japanese Patent Application No. 2018-118188, filed on Jun. 21, 2018. The contents of this application are incorporated herein by reference in its entirety.

TECHNICAL FIELD

The present invention relates to a rotary atomization head and a coating device.

BACKGROUND ART

A coating device including a rotary head (rotary atomization head) is conventionally known (for example, see Patent Document 1). In such a coating device, a coating material is discharged from a rotary head and thus pulverized (atomized), so that the pulverized coating material is applied to an object to be coated.

The rotary head of Patent Document 1 includes: a diffusion face on which the coating material is diffused by centrifugal force toward an outer edge part; and a plurality of grooves formed on an outer edge part. With this configuration, the coating material passes through the grooves and is discharged like threads from the rotary head. Then, the coating material in the state of threads is pulverized so as to be applied to the object to be coated.

PRIOR ART DOCUMENT

Patent Document

Patent Document 1: JP 2017-042749 A

SUMMARY OF THE INVENTION

Problem to be Solved by the Invention

Here, in the coating material discharged like threads from the rotary head, when the adjacent threads of the coating material in the circumferential direction make contact with each other and are unified (combined), the atomization function may be degraded.

The present invention was made in consideration of the above problem, an object of which is to provide a rotary atomization head and a coating device capable of preventing threads of the coating material from making contact with each other and from being unified.

Means for Solving the Problem

A rotary atomization head of the present invention is attachable to a rotary shaft of a coating device such that a coating material is supplied to the rotary atomization head when the rotary atomization head is attached to the rotary shaft of the coating device. The rotary atomization head includes: a diffusion surface configured to diffuse the coating material toward an outer edge part by centrifugal force; and a plurality of grooves formed on the outer edge part. The plurality of grooves is configured to extend in a radial direction. The plurality of grooves is configured such that adjacent grooves thereof have different depths. The plurality of grooves have a same width. Here, the same width means not only exactly the same width but also substantially the same width.

With the above-described configuration, since the adjacent grooves have different depths, discharge positions of the adjacent grooves for discharging the thread-like coating material differ from each other (i.e. the discharge position of the thread-like coating material is shifted in the axial direction from the adjacent discharge position of the thread-like coating material). Thus, it is possible to prevent the discharged threads of the coating material from making contact with each other. Also, since the grooves have the same width, it is possible that the respective threads of the coating material that are discharged from the grooves have substantially the same diameter.

In the above-described rotary atomization head, the plurality of grooves may include a first groove and a second groove that are alternately arranged in a circumferential direction. The depth of the first groove may be set greater than the depth of the second groove, and the width of the first groove may be set equal to the width of the second groove.

With the above-described configuration, it is possible to easily make the adjacent grooves have different depths.

In the above-described rotary atomization head including the first groove and the second groove, the depth and the width of the first groove may be formed so as to gradually increase from an inside in the radial direction to a discharge end in the direction in which the first groove extends, and the depth and the width of the second groove may be formed so as to gradually increase from the inside in the radial direction to a discharge end in the direction in which the second groove extends. The depth of the discharge end of the first groove may be set greater than the depth of the discharge end of the second groove, and the width of the discharge end of the first groove is set equal to the width of the discharge end of the second groove.

With the above-described configuration, it is possible to form the first groove and the second groove that have different depths at their respective discharge ends.

In the above-described rotary atomization head including the first groove and the second groove, the depth and the width of the first groove may be constant in the direction in which the first groove extends, and the depth and the width of the second groove may be constant in the direction in which the second groove extends.

With the above-described configuration, it is possible to form the first groove and the second groove that have different depths.

A coating device of the present invention includes: the above-described rotary atomization head; and a drive unit configured to rotate the rotary atomization head.

With the above-described configuration, since the adjacent grooves have different depths, discharge positions of the adjacent grooves for discharging the thread-like coating material differ from each other (i.e. the discharge position of the thread-like coating material is shifted in the axial direction from the adjacent discharge position of the thread-like coating material). Thus, it is possible to prevent the discharged threads of the coating material from making contact with each other. Also, since the grooves have the same width, it is possible that the respective threads of the coating material that are discharged from the grooves have substantially the same diameter.

The above-described coating device may include a power supply unit configured to apply a voltage to the rotary atomization head so as to generate an electric field between the rotary atomization head and a grounded object to be coated, so that the coating material in a state of threads that is discharged from the rotary atomization head is electrostatically pulverized.

With the above-described configuration, the coating material can be appropriately pulverized without being affected by shaping air.

Advantageous Effect of the Invention

With the rotary atomization head and the coating device of the present invention, it is possible to prevent threads of the coating material from making contact with each other and from being unified.

DESCRIPTION OF EMBODIMENTS

Hereinafter, embodiments of the present invention will be described with reference to the drawings.

First Embodiment

Here, a coating device 100 according to the first embodiment of the present invention is described with reference to FIGS. 1 and 2.

Figure 1:
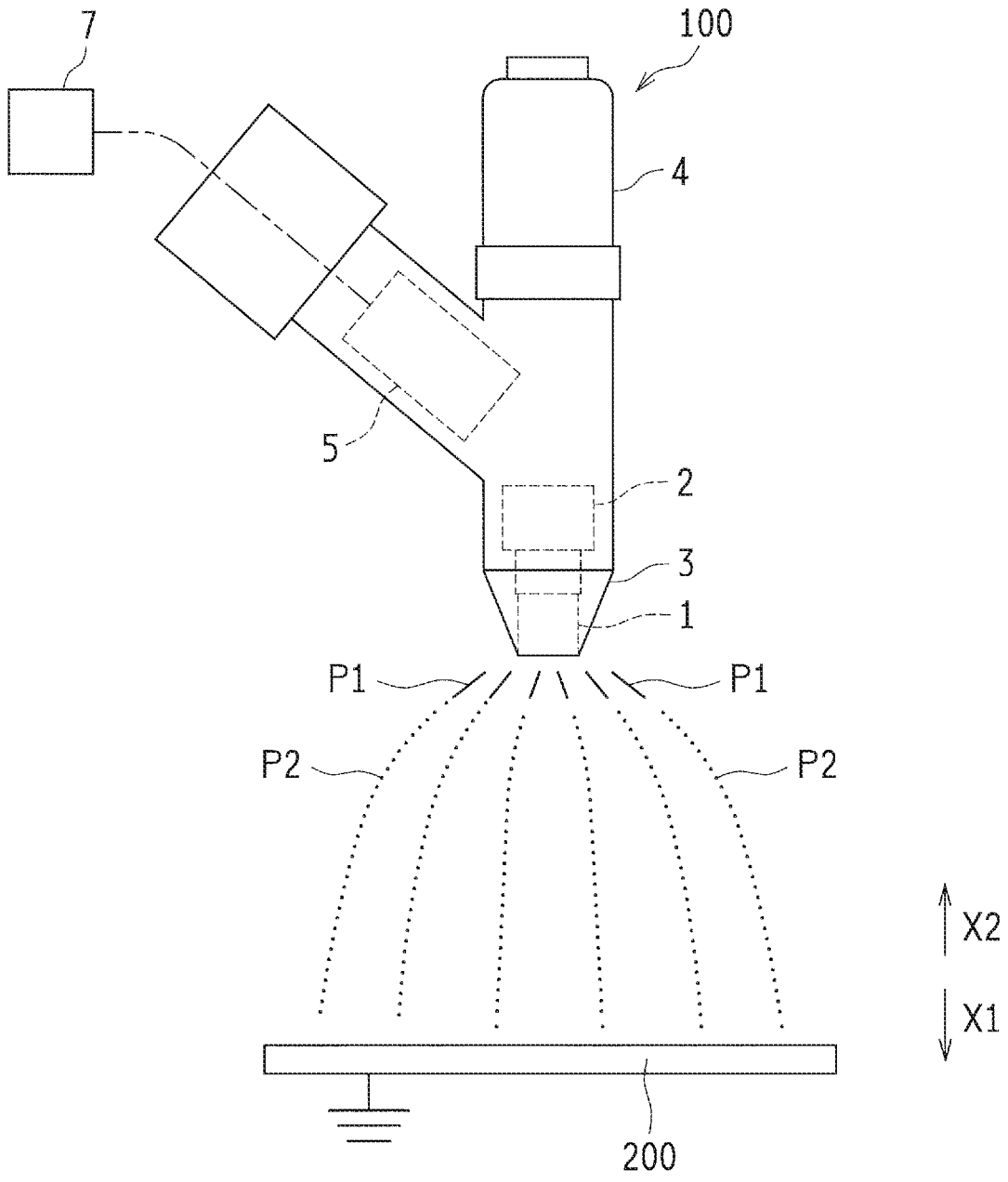
FIG. 1 is a schematic configuration diagram illustrating a coating device according to a first embodiment.

As shown in FIG. 1, the coating device 100 is configured to: discharge a coating material P1 in a state of threads from a rotary head 1; pulverize (atomize) the coating material P1 in the state of threads so as to form coating particles (pulverized coating material) P2; and apply the coating particles P2 to an object 200 to be coated. The object 200 to be coated means, for example, a vehicle body. The coating device 100 includes: the rotary head 1; an air motor 2; a cap 3; a coating material supply part 4; and a voltage generator 5.

To the rotary head 1, a liquid coating material is supplied. The rotary head 1 discharges the coating material by the centrifugal force. As shown in the example in FIG. 2, the rotary head 1 is formed so as to have a cylinder shape, and includes an attachment part 11 that is provided on the base end side (in the X2 direction) and a head part 12 provided on the tip end side (in the X1 direction). The attachment part 11 is attachable to a rotary shaft 21 of the air motor 2. To the head part 12, the liquid coating material is supplied. The diameter of the rotary head 1 is, for example, in the range of 20 to 80 mm. Also, the rotary head 1 is an example of a "rotary atomization head" of the present invention.

A rotary shaft 21 is attached to an inner circumferential surface of the attachment part 11. The rotary shaft 21 is formed so as to have a hollow shape, and a coating material supply pipe 6 is disposed in the rotary shaft 21. The coating material supply pipe 6 is disposed to supply the coating material stored in the coating material supply part 4 (see FIG. 1) to the head part 12. A nozzle (not shown) is disposed on a tip 61.

The head part 12 has an inner surface 12*a* and an outer surface 12*b*. The inner surface 12*a* is formed such that its diameter expands toward the tip end. At the center of the inner surface 12*a* is formed a recess part 121 having a circular shape viewed from the axial direction. A hub 13 is provided so as to close the recess part 121. Thus, a space S for coating material is defined by the recess part 121 and the hub 13. The tip 61 of the coating material supply pipe 6 is disposed so as to enter the space S for coating material. In an outer edge part of the hub 13, outflow holes 13*a* are formed such that the coating material flows out of the space S for coating material. The outflow holes 13*a* are each disposed at a predetermined interval in the circumferential direction (i.e. the rotational direction of the rotary head 1).

A part of the inner surface 12*a*, which positions outside relative to the outflow holes 13*a* in the radial direction (i.e. the direction orthogonal to the axial direction of the rotary head 1), serves as a diffusion surface 122 on which the coating material is diffused by the centrifugal force. The diffusion surface 122 is formed such that its diameter expands toward the tip end, thus the diffusion surface 122 makes a film of the coating material that flows through the outflow holes 13*a*. Also on an outer edge part 123 of the diffusion surface 122, a plurality of grooves 124 is formed (see FIG. 3) so as to transform the film-shaped coating material to the shape of threads to be discharged. Note that, in FIG. 2, the grooves 124 are omitted for the sake of visibility. The number of the grooves 124 depends on the diameter of the rotary head 1, however, it is, for example, in the range of 300 to 1800. The grooves 124 will be described later in detail.

An air motor 2 (see FIG. 1) is provided to rotate the rotary head 1. The air motor 2 has the rotatable rotary shaft 21 that is connected to the rotary head 1. The air motor 2 is an example of a "drive unit" of the present invention.

The cap 3 is disposed so as to cover the outer circumferential surface of the rotary head 1 and has a tapered shape such that its diameter decreases toward the tip end. The cap 3 is formed so as to have a torus shape viewed from the axial direction of the rotary head 1. The rotary head 1 is disposed inside the cap 3. That is, the cap 3 is provided so as to surround the rotary head 1.

As shown in FIG. 1, the coating material supply part 4 is detachably attached. The coating material is stored in the coating material supply part 4. The coating material stored in the coating material supply part 4 can be supplied to the rotary head 1 through the coating material supply pipe 6 (see FIG. 2).

The voltage generator 5 generates a negative high voltage and applies thus generated negative high voltage to the rotary head 1. The voltage generator 5 is provided to generate an electric field between the grounded object 200 to be coated and the rotary head 1. Due to the electric field between the object 200 to be coated and the rotary head 1, the coating material P1 in the state of threads is electrostatically pulverized, and the charged coating particles P2 are applied to the object 200 to be coated. Also, the voltage generator 5 is connected to a voltage controller 7, accordingly, an output voltage of the voltage generator 5 can be controlled by the voltage controller 7. The voltage controller 7 is provided to reduce changes in the electric field intensity between the rotary head 1 and the object 200 to be coated by controlling the voltage applied to the rotary head 1. The voltage generator 5 is an example of a "power supply unit" of the present invention.

In the above coating device 100, the coating material P1 in the state of threads is discharged through the grooves 124 of the rotary head 1 while the coating material P1 in the state of threads is electrostatically pulverized (atomized). Thus, since the coating device 100 does not include an air discharge part to discharge shaping air, the coating particles P2 is formed without the shaping air.

—Grooves of Rotary Head—

Here, the grooves 124 of the rotary head 1 according to the first embodiment are described in detail with reference to FIGS. 3 to 7.

Figure 3:
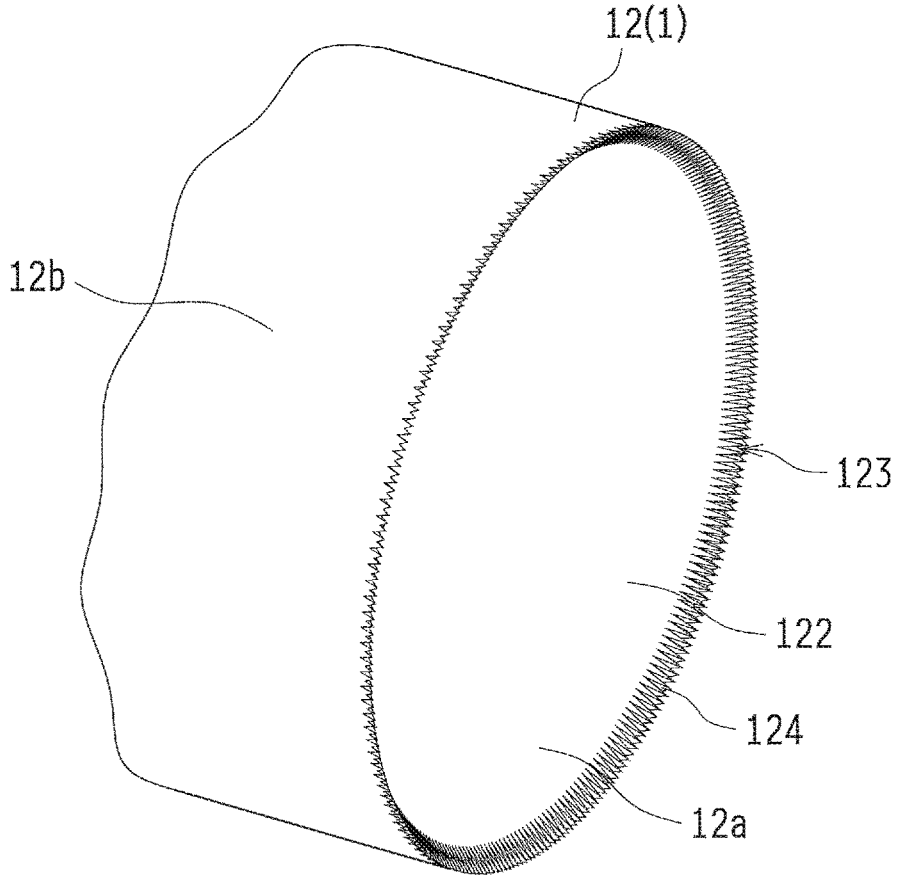
FIG. 3 is a perspective view illustrating a tip portion of the rotary head in FIG. 2.

As shown in FIG. 3, the plurality of grooves 124 is formed on the outer edge part 123 of the diffusion surface 122 so as to transform the film-shaped coating material to the shape of threads to be discharged. The plurality of grooves 124 is formed so as to extend in the radial direction, and is set such that the adjacent grooves 124 have different depths and that the respective grooves 124 have the same width. Here, the same width means not only exactly the same width but also substantially the same width.

Figure 4:
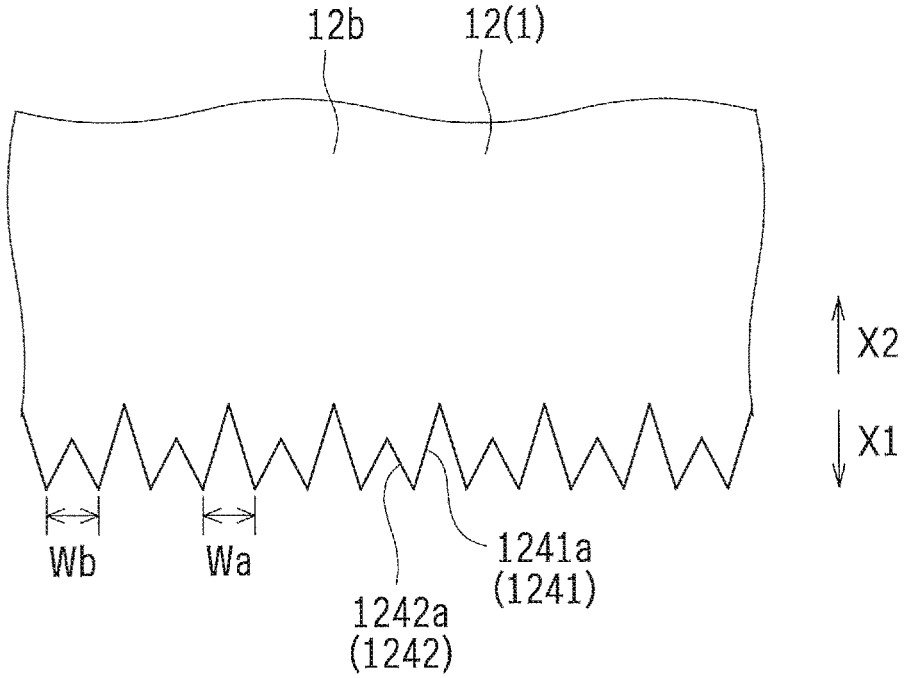
FIG. 4 is an enlarged diagram of the tip portion of the rotary head in FIG. 3, viewed from the outside in the radial direction.
Figure 5:
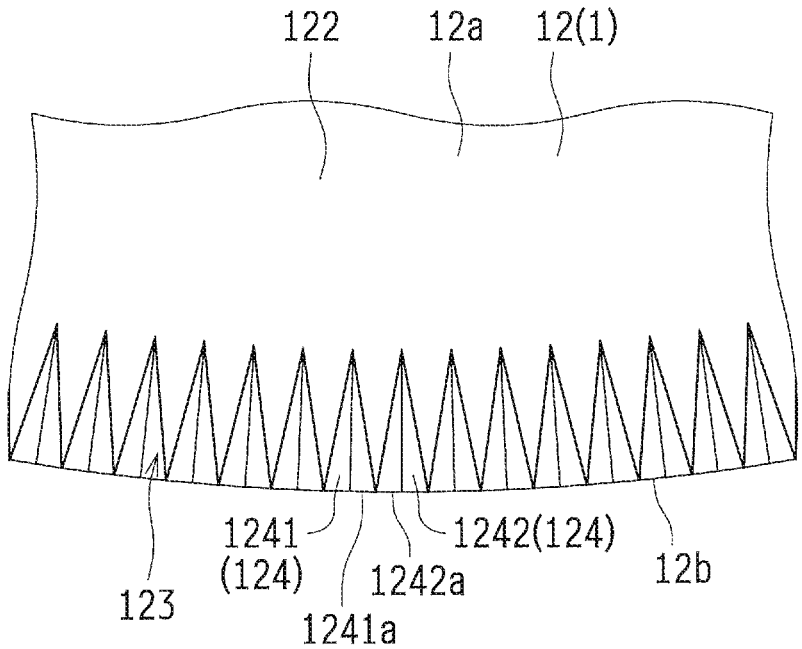
FIG. 5 is an enlarged diagram of the tip portion of the rotary head in FIG. 3, viewed from the axial direction.
Figure 6:
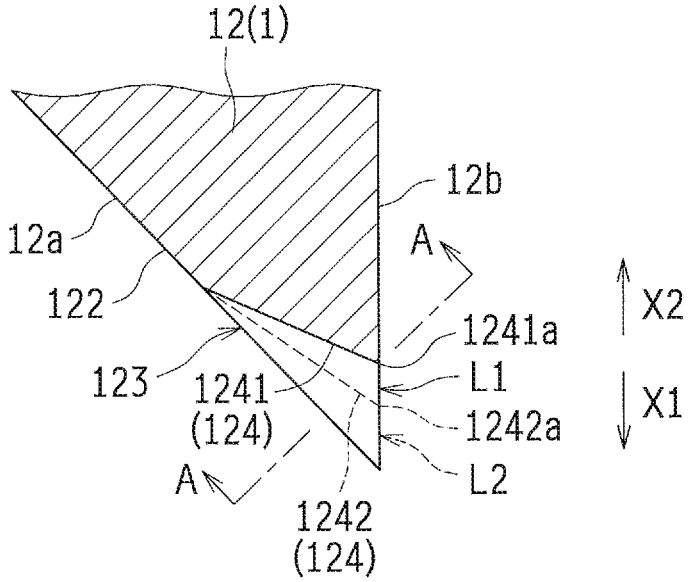
FIG. 6 is a sectional end view illustrating the enlarged tip portion of the rotary head in FIG. 3.

Specifically, the plurality of grooves 124 includes grooves 1241 and 1242, which are alternately arranged in the circumferential direction, as shown in FIGS. 4 to 6. The grooves 1241 and 1242 each have a cross-section, for example, in the V-shape (triangular shape), and also each have the same length. Therefore, each inner end part of the grooves 1241 and 1242 in the radial direction is disposed at a predetermined interval in the circumferential direction when viewed from the axial direction, as shown in FIG. 5. Also, outer end parts of the grooves 1241 and 1242 in the radial direction serve as discharge ends 1241*a* and 1242*a* of the coating material, and thus are formed so as to reach the outer surface 12*b* of the head part 12. Thus, as shown in FIG. 4, the cross-sections of the grooves 1241 and 1242 appear at the outer surface 12*b*, and the tip of the rotary head 1 has an uneven shape when viewed from the outer surface 12*b* side. The grooves 1241 and 1242 are respectively examples of a "first groove" and a "second groove" of the present invention.

As shown in FIGS. 5 and 6, the depth and the width of the groove 1241 are formed so as to gradually increase from the inside in the radial direction to the discharge end 1241*a* in the direction in which the groove 1241 extends. Similarly to the above, the depth and the width of the groove 1242 are formed so as to gradually increase from the inside in the radial direction to the discharge end 1242*a* in the direction in which the groove 1242 extends. That is, the grooves 1241 and 1242 are each formed such that the V-shaped cross-sectional area increases toward the outside in the radial direction. The depth of the discharge end 1241*a* of the groove 1241 is set greater than the depth of the discharge end 1242*a* of the groove 1242. Also, the width Wa (see FIG. 4) of the discharge end 1241*a* of the groove 1241 is set equal to the width Wb (see FIG. 4) of the discharge end 1242*a* of the groove 1242. Accordingly, as shown in FIG. 6, the inclination degree of the bottom part of the groove 1241 relative to the axial direction is set larger than the inclination degree of the bottom part of the groove 1242 relative to the axial direction. Also, the inclination degree of the bottom part of the groove 1242 relative to the axial direction is set larger than the inclination degree of the diffusion surface 122 relative to the axial direction.

Figure 7:
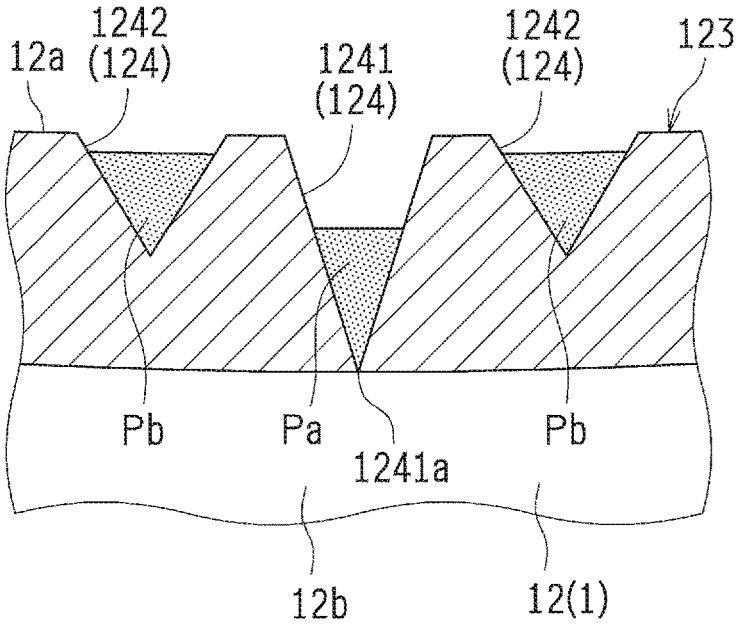
FIG. 7 is a cross-sectional view taken from line A-A of FIG. 6, which illustrates a state in which a coating material flows into grooves of the rotary head in FIG. 6.

Thus, the width Wa of the discharge end 1241*a* of the groove 1241 is set equal to the width Wb of the discharge end 1242*a* of the groove 1242, and also the length of the occupancy area in the circumferential direction for forming the groove 1241 in the inner surface 12*a* of the rotary head 1 is set equal to the length of the occupancy area in the circumferential direction for forming the groove 1242 in the inner surface 12*a* of the rotary head 1. In this way, as shown in FIG. 7, the amount of a coating material Pa that flows into the groove 1241 is equal to the amount of a coating material Pb that flows into the groove 1242. That is, the cross-sectional area of the coating material Pa in the groove 1241 is equal to the cross-sectional area of a coating material Pb of the groove 1242. Thus, the diameter of the thread-like coating material P1 that is discharged through the groove 1241 is equal to the diameter of the thread-like coating material P1 that is discharged through the groove 1242.

As shown in FIG. 6, the bottom part of the discharge end 1242*a* of the groove 1242 is disposed closer to the tip than the bottom part of the discharge end 1241*a* of the groove 1241 is disposed. In this way, a discharge position L1 of the thread-like coating material P1 that is discharged through the groove 1241 is shifted in the axial direction from a discharge position L2 of the thread-like coating material P1 that is discharged through the groove 1242. That is, in the rotary head 1, the thread-like coating material P1 through the groove 1242 is discharged from the further tip end compared to the thread-like coating material P1 through the groove 1241.

—Operation Example when Coating is Performed—

Here, an operation example of the coating device 100 is described with reference to FIGS. 1 to 7.

When the coating is performed, a negative high voltage is applied to the rotary head 1 by the voltage generator 5 while the object 200 to be coated is grounded as shown in FIG. 1. Thus, an electric field is generated between the rotary head 1 and the grounded object 200 to be coated. The negative high voltage is, for example, in the range of −30000 to −70000 V. The rotary head 1 is rotated at a high speed by the air motor 2. The rotational speed (number of rotations per minute) of the rotary head 1 depends on the diameter of the rotary head 1. However, it is, for example, in the range of 10000 to 50000 rpm.

Figure 2:
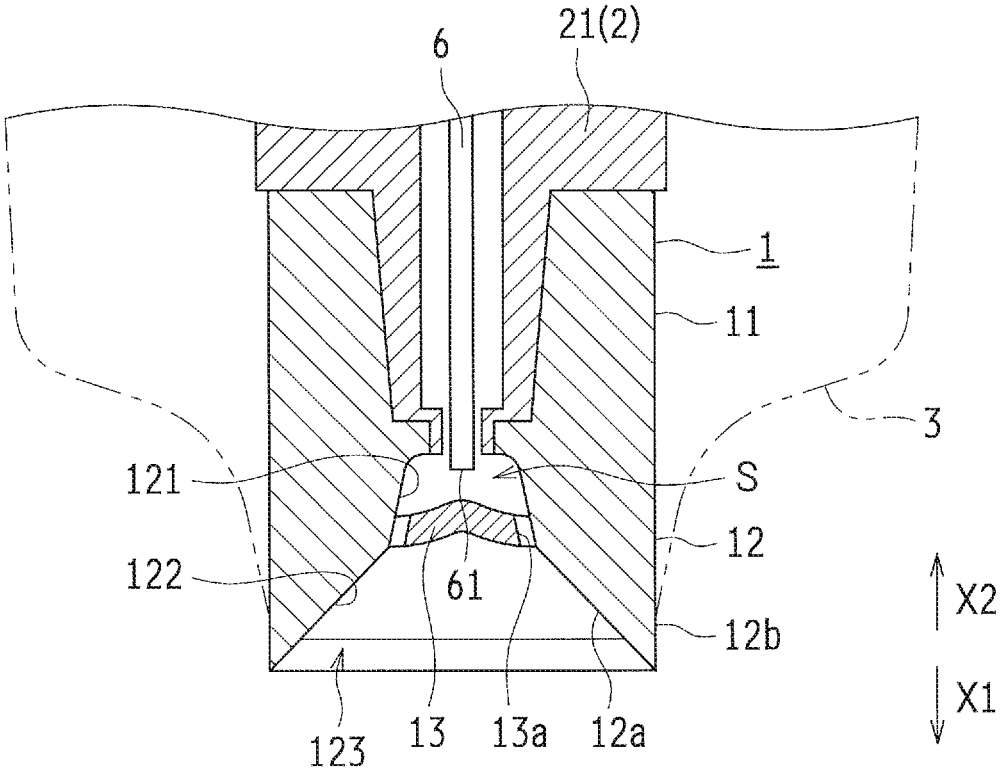
FIG. 2 is a cross-sectional view illustrating a rotary head of the coating device in FIG. 1.

Then, as shown in FIG. 2, a liquid coating material is discharged from the nozzle of the coating material supply pipe 6 so as to be supplied into the space S for coating material. The flow rate of the coating material discharged from the nozzle depends on the diameter of the rotary head 1. However, it is, for example, in the range of 10 to 300 cc/min. The coating material supplied into the space S for coating material flows from the outflow hole 13*a* by the centrifugal force.

The coating material that has flown from the outflow hole 13*a* further flows along the diffusion surface 122 toward the outer side in the radial direction by the centrifugal force. The coating material that flows along the diffusion surface 122 while forming a film shape reaches the outer edge part 123 so as to be supplied to the plurality of grooves 124 (see FIG. 3). By flowing into the grooves 124, the film-shaped coating material is divided in the circumferential direction before it reaches the outer end of the rotary head 1 in the radial direction. That is, as shown in FIG. 7, the coating material does not flow over the grooves 124 at least at the outer end of the rotary head 1 in the radial direction, and each portion of the coating material in the corresponding groove 124 is separated from the portion of the coating material in the adjacent groove 124. When passing through the groove 124, the coating material makes a thread shape, and accordingly, the coating material P1 in the state of threads (see FIG. 1) is discharged from the outer end (i.e. grooves 124 that appear at the outer surface 12*b*) of the rotary head 1 in the radial direction.

Here, as shown in FIGS. 4 to 7, the plurality of grooves 124 is constituted of the grooves 1241 and 1242 that have respectively different depths, and the grooves 1241 and 1242 are alternately arranged in the circumferential direction. In this way, the discharge position L1 (see FIG. 6) of the thread-like coating material P1 that is discharged through the groove 1241 is shifted in the axial direction from the discharge position L2 (see FIG. 6) of the thread-like coating material P1 that is discharged through the groove 1242, and furthermore, the thread-like coating material P1 discharged from the discharge position L1 and the thread-like coating material P1 discharged from the discharge position L2 have the same diameter and alternately disposed in the circumferential direction. Thus, the interval between the threads of the coating material P1 adjacent to each other in the circumferential direction is large, which prevents the threads of the coating material P1 adjacent to each other from making contact with each other.

Also, the groove 1241 and the groove 1242 have the same width, accordingly, the film-shaped coating material having the uniform thickness by the centrifugal force is substantially evenly supplied to the grooves 1241 and 1242. Therefore, the amount of the coating material Pa (see FIG. 7) that flows into the groove 1241 is substantially equal to the amount of the coating material Pb (see FIG. 7) that flows into the groove 1242. That is, since the respective amounts of the coating material that flow into the grooves 124 aligned in the circumferential direction are correlated with the widths of the grooves 124, it is possible to supply evenly the coating material to the respective grooves 124 by forming the grooves 124 having the same width, regardless of the depths of the grooves 124. Thus, the diameter of the thread-like coating material P1 discharged from the groove 1241 is substantially equal to the diameter of the thread-like coating material P1 discharged from the groove 1242. In brief, by evenly supplying the coating material that flows into the respective grooves 124, the respective flows of the thread-like coating material P1 discharged from the grooves 124 have the same diameter.

The coating material P1 in the state of threads discharged from the rotary head 1 is electrostatically pulverized. The size of the thread-like coating material P1 depends on the diameter of the rotary head 1 and/or the kind of the coating material. However, for example, the diameter is in the range of 0.03 to 0.1 mm, and the length is in the range of 2 to 46 mm. The size of the thread-like coating material P1 is adjusted according to the flow rate of the coating material, the rotational speed of the rotary head 1 and the like. The coating particles P2 (see FIG. 1) electrostatically pulverized and formed have, for example, a Sauter Means Diameter of 10 to 50 μm. The coating particles P2 are negatively charged and attracted to the grounded object 200 to be coated. Thus, the coating particles P2 are applied to the object 200 to be coated and a coating film (not shown) is formed on the surface of the object 200 to be coated.

The voltage that is applied to the rotary head 1 by the voltage generator 5 may be controlled by the voltage controller 7 (see FIG. 1). For example, the voltage controller 7 adjusts the voltage that is applied to the rotary head 1 by the voltage generator 5 such that the current (discharge current) that flows between the rotary head 1 and the object 200 to be coated is constant. Specifically, when the distance between the rotary head 1 and the object 200 to be coated becomes small and the discharge current increases, the voltage applied to the rotary head 1 is reduced so as to cancel the change in the discharge current. On the other hand, when the distance between the rotary head 1 and the object 200 to be coated becomes large and the discharge current decreases, the voltage applied to the rotary head 1 is increased so as to cancel the change in the discharge current. In this way, it is possible to prevent fluctuations in the electric field intensity between the rotary head 1 and the object 200 to be coated.

—Effects—

In the first embodiment, since the grooves 1241 and 1242 having different depths are alternately arranged in the circumferential direction as described above, the adjacent discharge positions of the grooves 124 for discharging the thread-like coating material P1 differ from each other (i.e. the discharge position L1 of the groove 1241 is shifted in the axial direction from the discharge position L2 of the groove 1242). Thus, it is possible to prevent the discharged threads of the coating material P1 from making contact with each other and from being unified. Also, by forming the grooves 1241 and 1242 such that they have the same width, it is possible that the respective threads of the coating material P1 that are discharged from the grooves 1241 and 1242 have substantially the same diameter. Therefore, the pulverizing function can be improved by miniaturizing and equaling the discharged thread-like coating material P1. As a result, the coating particles P2 can be pulverized and uniformed, which leads to improvement of the coating quality.

Second Embodiment

Here, a rotary head 1*a* according to the second embodiment of the present invention is described with reference to FIGS. 8 to 11. In the second embodiment, the respective inclination degrees of the bottom parts of grooves 125 of the rotary head 1*a* are the same, unlike the first embodiment. The rotary head 1*a* is an example of a "rotary atomization head" of the present invention.

Figure 8:
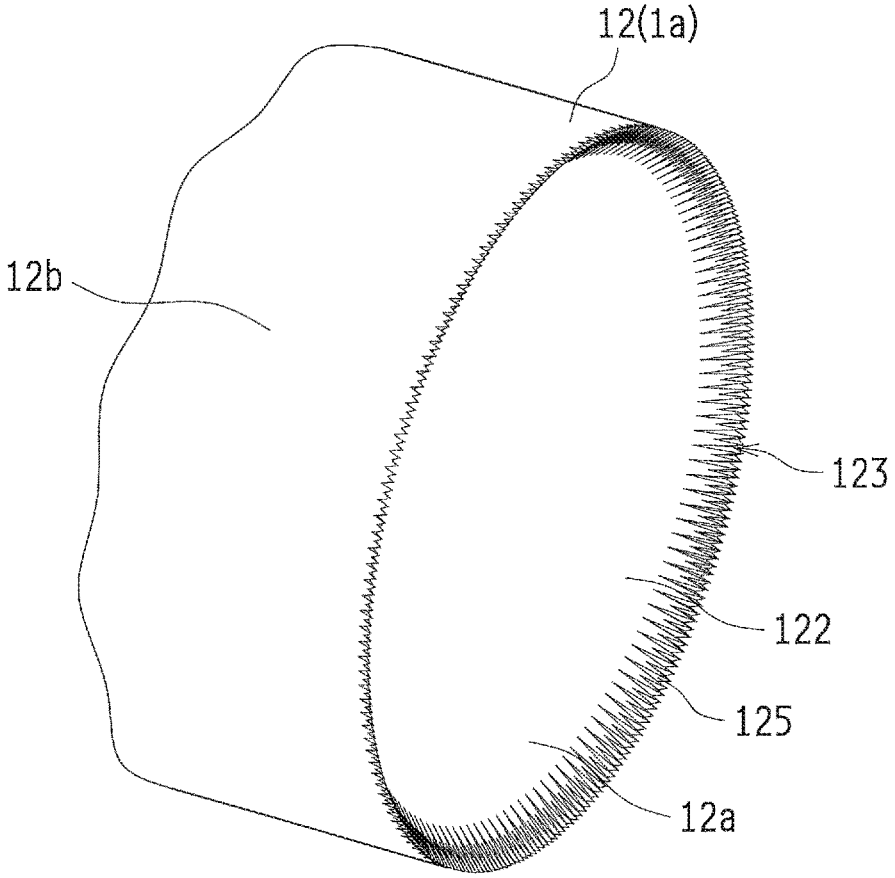
FIG. 8 is a perspective view illustrating a tip portion of the rotary head according to a second embodiment.

In the second embodiment, the plurality of grooves 125 is formed on the outer edge part 123 of the diffusion surface 122 so as to transform the film-shaped coating material to the shape of threads to be discharged, as shown in FIG. 8. The plurality of grooves 125 is formed so as to extend in the radial direction, and is set such that the adjacent grooves 125 have different depths and that the respective grooves 125 have the same width.

Figure 9:
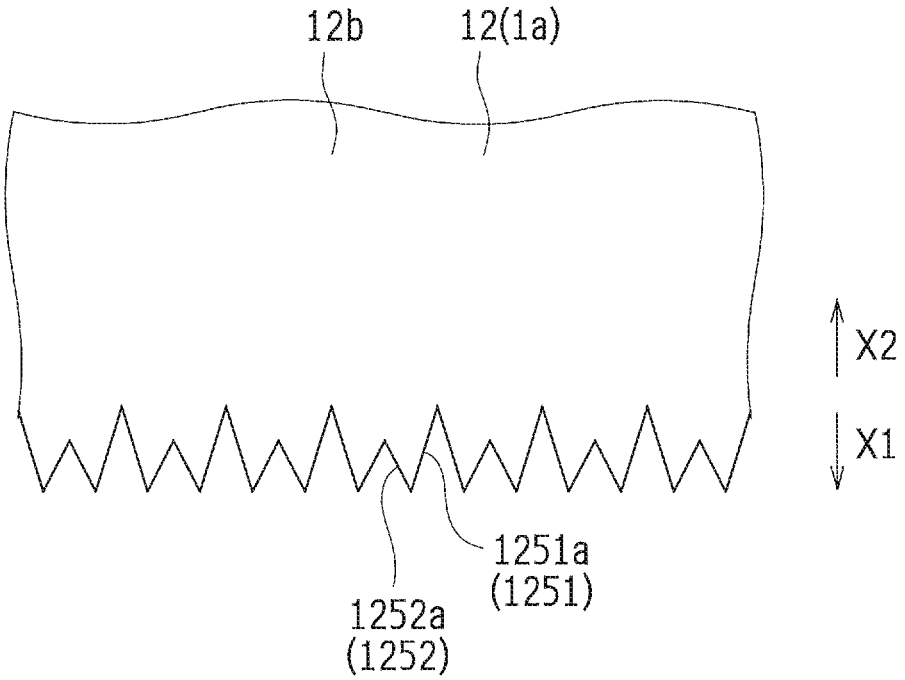
FIG. 9 is an enlarged diagram of the tip portion of the rotary head in FIG. 8, viewed from the outside in the radial direction.
Figure 10:
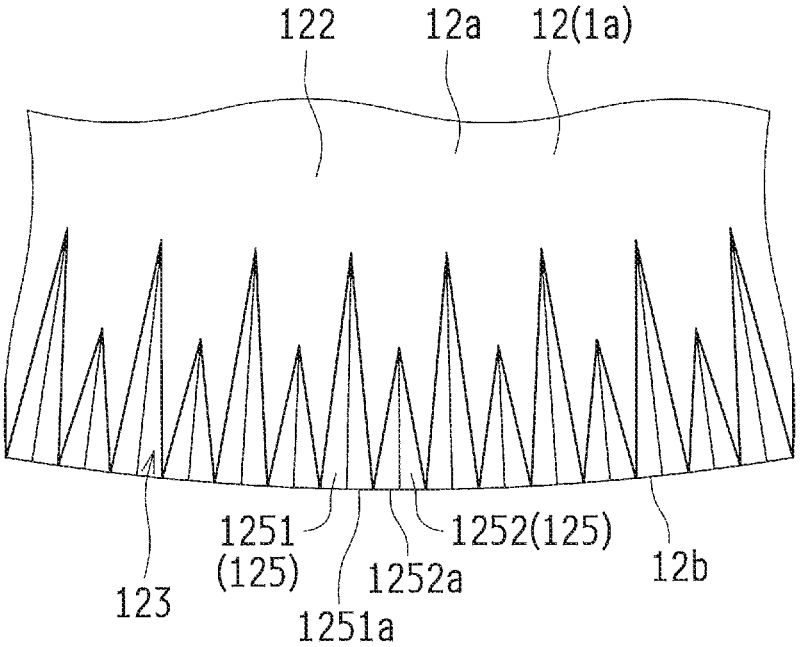
FIG. 10 is an enlarged diagram of the tip portion of the rotary head in FIG. 8, viewed from the axial direction.
Figure 11:
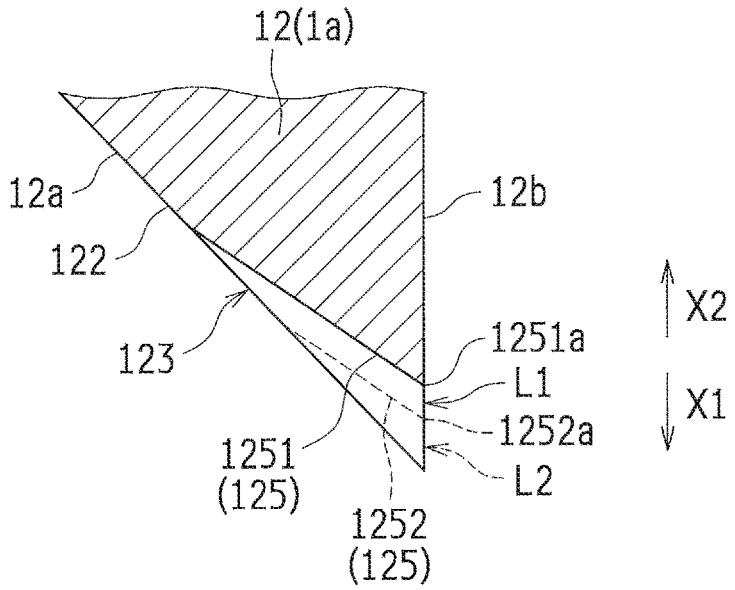
FIG. 11 is a sectional end view illustrating the enlarged tip portion of the rotary head in FIG. 8.

Specifically, the plurality of grooves 125 includes grooves 1251 and 1252, which are alternately arranged in the circumferential direction, as shown in FIG. 9. The respective inclination degrees of the bottom parts of the grooves 1251 and 1252 relative to the axial direction are the same, as shown in FIG. 11. Also, the groove 1251 is formed so as to have a length greater than the length of the groove 1252 and to extend toward the inside in the radial direction longer than the groove 1252 extends, as shown in FIG. 10. The other configurations of the grooves 1251 and 1252 are the same as the configurations of the above-described grooves 1241 and 1242. The grooves 1251 and 1252 are respectively examples of a "first groove" and a "second groove" of the present invention.

Therefore, the depth of a discharge end 1251*a* of the groove 1251 is greater than the depth of a discharge end 1252*a* of the groove 1252. Also, the width of the discharge end 1251*a* of the groove 1251 is set equal to the width of the discharge end 1252*a* of the groove 1252.

The other configurations and effects of the second embodiment are the same as those of the first embodiment.

Third Embodiment

Here, a rotary head 1*b* according to the third embodiment of the present invention is described with reference to FIGS. 12 to 15. In the third embodiment, the cross-sectional shapes of grooves 126 of the rotary head 1*b* in the direction in which the grooves 126 extend are the same, unlike the first embodiment. The rotary head 1*b* is an example of a "rotary atomization head" of the present invention.

Figure 12:
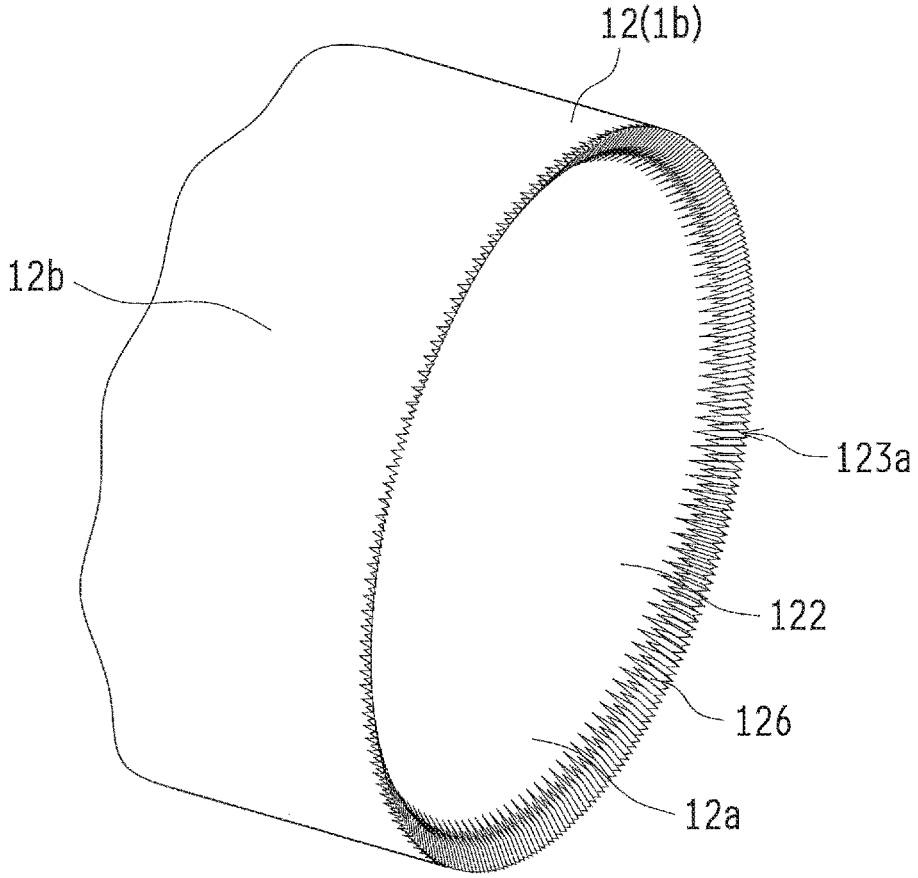
FIG. 12 is a perspective view illustrating a tip portion of the rotary head according to a third embodiment.

In the third embodiment, the plurality of grooves 126 is formed on an outer edge part 123*a* of the diffusion surface 122 so as to transform the film-shaped coating material to the shape of threads to be discharged, as shown in FIG. 12. The plurality of grooves 126 is formed so as to extend in the radial direction, and is set such that the adjacent grooves 126 have different depths and that the respective grooves 126 have the same width. Here, the inclination degree of the outer edge part 123*a* relative to the axial direction is larger than that of the diffusion surface 122. That is, the outer edge part 123*a* has the degree of diameter enlargement that is larger than the degree of diameter enlargement of the diffusion surface 122.

Figure 13:
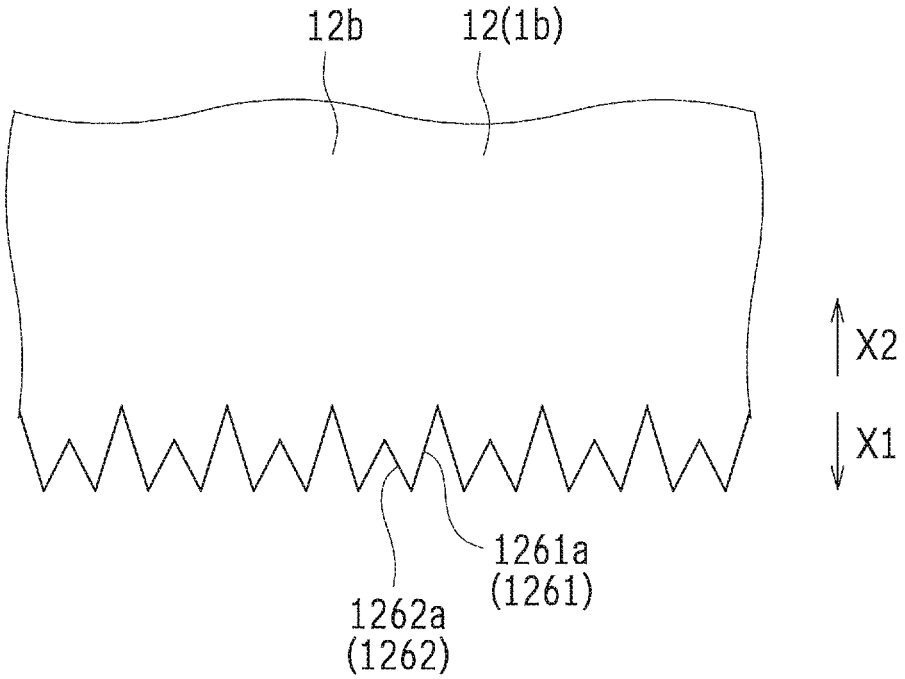
FIG. 13 is an enlarged diagram of the tip portion of the rotary head in FIG. 12, viewed from the outside in the radial direction.
Figure 14:
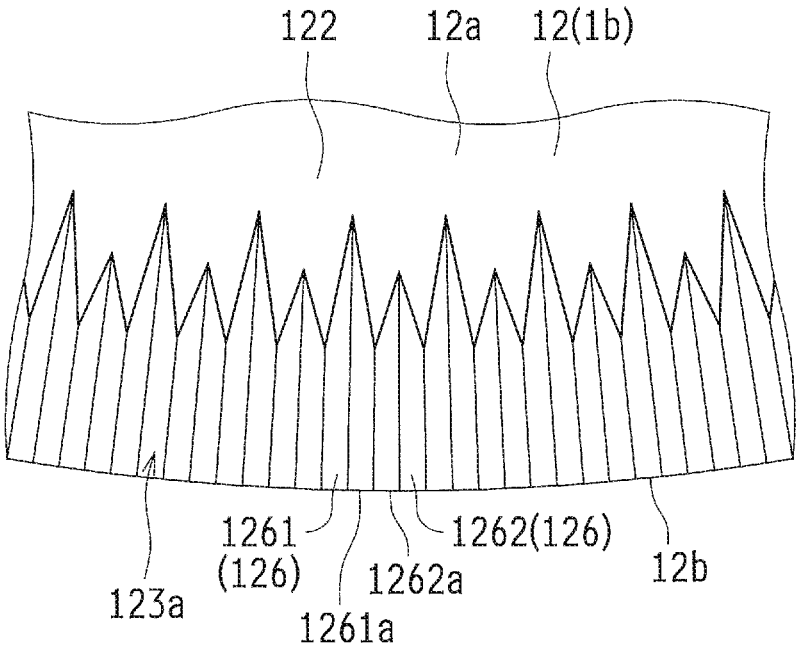
FIG. 14 is an enlarged diagram of the tip portion of the rotary head in FIG. 12, viewed from the axial direction.

Specifically, the plurality of grooves 126 includes grooves 1261 and 1262, which are alternately arranged in the circumferential direction, as shown in FIG. 13. The depth and the width of the groove 1261 are both constant at the outer edge part 123*a* in the direction in which the groove 1261 extends, and furthermore the depth and the width of the groove 1262 are both constant at the outer edge part 123*a* in the direction in which the groove 1262 extends, as shown in FIGS. 14 and 15.

Figure 15:
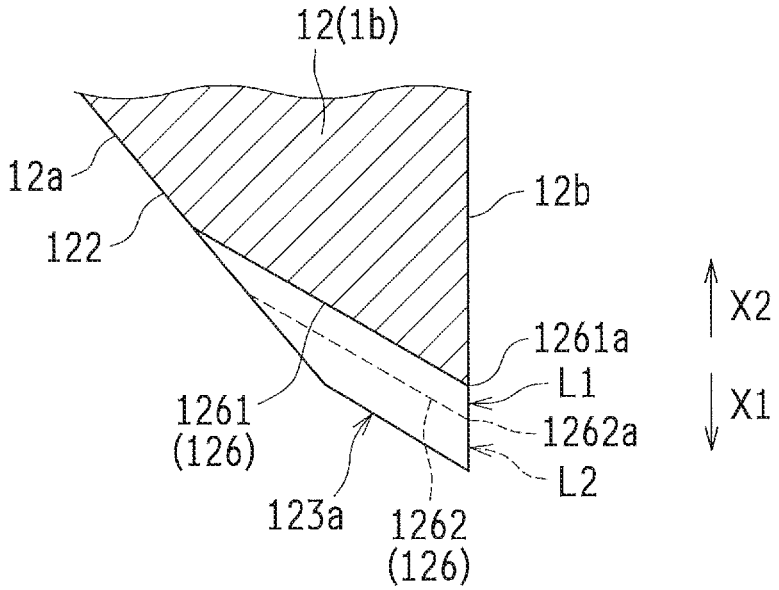
FIG. 15 is a sectional end view illustrating the enlarged tip portion of the rotary head in FIG. 12.

The respective inclination degrees of the bottom parts of the grooves 1261 and 1262 relative to the axial direction are the same, as shown in FIG. 15. Also, the groove 1261 is formed so as to have a length greater than the length of the groove 1262 and to extend toward the inside in the radial direction longer than the groove 1262 extends, as shown in FIG. 14. The grooves 1261 and 1262 are each formed such that the V-shaped cross-sectional area in the diffusion surface 122 decreases toward the inside in the radial direction. The other configurations of the grooves 1261 and 1262 are the same as the configurations of the above-described grooves 1241 and 1242. The grooves 1261 and 1262 are respectively examples of a "first groove" and a "second groove" of the present invention.

The depth of a discharge end 1261*a* of the groove 1261 is set greater than the depth of a discharge end 1262*a* of the groove 1262. Also, the width of the discharge end 1261*a* of the groove 1261 is set equal to the width of the discharge end 1262*a* of the groove 1262.

The other configurations and effects of the third embodiment are the same as those of the first embodiment.

Other Embodiments

The above embodiments are to be considered in all respects as illustrative and not limiting. The scope of the invention is indicated by the appended claims rather than by the foregoing description, and all modifications and changes that come within the meaning and range of equivalency of the claims are intended to be embraced therein.

For example, in the first embodiment, the configuration is exemplarily described, in which no air discharge part for discharging shaping air is provided. However, the present invention is not limited thereto. The configuration may include an air discharge part for discharging shaping air. The above feature may also be included in the second and third embodiments.

Also in the first embodiment, the configuration is exemplarily described, in which the voltage applied to the rotary head 1 is adjusted according to the discharge current. However, the present invention is not limited thereto. The constant voltage may be applied to the rotary head regardless of the discharge current. The above feature may also be included in the second and third embodiments.

Also in the first embodiment, the configuration is exemplarily described, in which the rotary head 1 is formed in a cylinder shape. However, the present invention is not limited thereto. The rotary head may be formed so as to have a cup (bowl) shape. The above feature may also be included in the second and third embodiments.

Also in the first embodiment, the configuration is exemplarily described, in which the two kinds of grooves 1241 and 1242 respectively having different depths are provided. However, the present invention is not limited thereto. Three or more kinds of grooves respectively having different depths may be provided. The above feature may also be included in the second and third embodiments.

Also in the first embodiment, the configuration is exemplarily described, in which the grooves 124 each have the V-shaped cross section. However, the present invention is not limited thereto. The cross-section of the groove may have another shape such as a U-shape (arc shape). The above feature may also be included in the second and third embodiments.

Also in the first embodiment, the configuration is exemplarily described, in which the outflow holes 13*a* are provided so as to discharge the coating material from the space S for coating material. However, the present invention is not limited thereto. Slit-like grooves may be formed so as to discharge the coating material from the space for coating material. The above feature may also be included in the second and third embodiments.

Also in the first to third embodiments, the coating material may be a water paint or a solvent based paint.

INDUSTRIAL APPLICABILITY

The present invention is suitably applied to a rotary atomization head and a coating device including the same.

REFERENCE SIGNS LIST

1, 1*a*, 1*b* Rotary head (rotary atomization head)
2 Air motor (drive unit)
5 Voltage generator (power supply unit)
21 Rotary shaft

100 Coating device
122 Diffusion surface
123, 123*a* Outer edge part
124, 125, 126 Groove
200 Object to be coated
1241, 1251, 1261 Groove (first groove)
1241*a*, 1242*a*, 1251*a*, 1252*a*, 1261*a*, 1262*a* Discharge end
1242, 1252, 1262 Groove (second groove)

What is claimed is:

1. A rotary atomization head attachable to a rotary shaft of a coating device configured to be supplied with a coating material when the rotary atomization head is attached to the rotary shaft of the coating device, the rotary atomization head comprising:

an inner surface; and an outer surface, wherein at least a portion of the inner surface being a diffusion surface configured to diffuse the coating material toward an outer edge part of the rotary atomization head by centrifugal force, the diffusion surface having a plurality of grooves formed thereon, the plurality of grooves extend in a radial direction from the inner surface to the outer edge part, the plurality of grooves is configured such that adjacent grooves thereof have different depths, each of the plurality of grooves have a same width, the plurality of grooves includes a first groove and a second groove that are alternately arranged in a circumferential direction, the first groove has a set first depth, which is greater than a set second depth of the second groove, a width of the first groove is set equal to a width of the second groove, and the second groove is respectively disposed directly adjacent to both sides of the first groove.

2. The rotary atomization head according to claim 1, wherein the depth and the width of the first groove are formed so as to gradually increase from an inside in the radial direction to a discharge end in a direction in which the first groove extends, the depth and the width of the second groove are formed so as to gradually increase from the inside in the radial direction to a discharge end in a direction in which the second groove extends, a depth of the discharge end of the first groove is set greater than a depth of the discharge end of the second groove, and a width of the discharge end of the first groove is set equal to a width of the discharge end of the second groove.

3. The rotary atomization head according to claim 1, wherein the depth and the width of the first groove are constant in a direction in which the first groove extends, and the depth and the width of the second groove are constant in a direction in which the second groove extends.

4. A coating device comprising:

the rotary atomization head according to claim 1; and a drive unit configured to rotate the rotary atomization head.

5. The coating device according to claim 4, comprising a power supply unit configured to apply a voltage to the rotary atomization head so as to generate an electric field between the rotary atomization head and a grounded object to be coated, wherein a coating material in a state of threads that is discharged from the rotary atomization head is electrostatically pulverized.

6. The rotary atomization head according to claim 1, wherein the plurality of grooves includes grooves having different inclination angles.

7. The rotary atomization head according to claim 1, wherein the plurality of grooves have a same inclination angle.

* * * * *